US009371721B2

(12) United States Patent
Hay et al.

(10) Patent No.: US 9,371,721 B2
(45) Date of Patent: Jun. 21, 2016

(54) SUBSURFACE WELL SYSTEMS WITH MULTIPLE DRAIN WELLS EXTENDING FROM PRODUCTION WELL AND METHODS FOR USE THEREOF

(75) Inventors: Richard T. Hay, Spring, TX (US); Gary Althoff, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 13/825,208

(22) PCT Filed: Mar. 2, 2012

(86) PCT No.: PCT/US2012/027432

§ 371 (c)(1),
(2), (4) Date: Aug. 25, 2014

(87) PCT Pub. No.: WO2013/130091

PCT Pub. Date: Sep. 6, 2013

(65) Prior Publication Data

US 2015/0008001 A1 Jan. 8, 2015

(51) Int. Cl.

| | |
|---|---|
| ***E21B 33/13*** | (2006.01) |
| ***E21B 33/03*** | (2006.01) |
| ***E21B 7/04*** | (2006.01) |
| ***E21B 43/00*** | (2006.01) |
| ***E21B 43/16*** | (2006.01) |
| ***E21B 29/12*** | (2006.01) |
| ***E21B 43/30*** | (2006.01) |
| ***E21B 43/14*** | (2006.01) |

(52) U.S. Cl.

CPC . *E21B 43/14* (2013.01); *E21B 7/04* (2013.01); *E21B 43/30* (2013.01); *E21B 43/305* (2013.01)

(58) Field of Classification Search

None

See application file for complete search history.

(56) References Cited

U.S. PATENT DOCUMENTS

| | | | | |
|---|---|---|---|---|
| 4,646,836 | A * | 3/1987 | Goodhart | E21B 4/02 166/272.1 |
| 4,658,916 | A | 4/1987 | Bond | |
| 5,458,209 | A | 10/1995 | Hayes et al. | |
| 6,920,945 | B1 | 7/2005 | Belew et al. | |
| 6,942,030 | B2 * | 9/2005 | Zupanick | E21B 41/0035 166/245 |
| 7,048,049 | B2 | 5/2006 | Zupanick | |

(Continued)

FOREIGN PATENT DOCUMENTS

| | | | |
|---|---|---|---|
| CA | 2285476 | A1 | 11/1998 |
| WO | 2013130091 | A1 | 9/2013 |

OTHER PUBLICATIONS

International Search Report and Written Opinion for PCT/US2012/027432 dated Nov. 16, 2012.

*Primary Examiner* — Matthew R Buck
*Assistant Examiner* — Douglas S Wood
(74) *Attorney, Agent, or Firm* — McDermott Will & Emery LLP; Scott Richardson

(57) ABSTRACT

Drain wells can be used to direct a fluid to a central production well in a subsurface well system. Subsurface well systems can include a production well extending from the earth's surface, a collection region having a fluid connection to the production well and either being contiguous with the production well or comprising a collection well that intersects or is in fluid communication with the production well, and at least one branched drain well extending laterally from the production well and including one or more branches that extend from the at least one branched drain well, wherein at least one of the one or more branches intersects or is in fluid communication with the collection region.

20 Claims, 7 Drawing Sheets

(56) References Cited

U.S. PATENT DOCUMENTS

| | | | | |
|---|---|---|---|---|
| 7,451,814 | B2 * | 11/2008 | Graham et al. | 166/268 |
| 7,513,304 | B2 | 4/2009 | Stayton | |
| 7,637,316 | B2 | 12/2009 | Best et al. | |
| 7,819,187 | B2 | 10/2010 | Graham et al. | |
| 7,878,270 | B2 | 2/2011 | Lee et al. | |
| 7,958,938 | B2 * | 6/2011 | Crossley | E21B 43/017 166/339 |
| 2010/0071904 | A1 * | 3/2010 | Burns | C10G 21/22 166/302 |
| 2011/0114388 | A1 | 5/2011 | Lee et al. | |

* cited by examiner

SUBSURFACE WELL SYSTEMS WITH MULTIPLE DRAIN WELLS EXTENDING FROM PRODUCTION WELL AND METHODS FOR USE THEREOF

CROSS-REFERENCE TO RELATED APPLICATIONS

The present application is a national stage entry from International Application No. PCT/US2012/027432 having an international filing date of Mar. 2, 2012, the contents of which are hereby incorporated by reference in their entirety.

BACKGROUND

The present disclosure generally relates to the production of fluids from a subterranean formation, and, more specifically, to subsurface well systems having multiple drain wells and methods for use thereof.

Multiple, interlinked wells are commonly used in subterranean operations to maximize the production of hydrocarbon fluids from a subterranean formation. The use of multiple, interlinked wells may result in higher production than can be obtained from multiple, non-interlinked wells. Interlinked wells can be particularly advantageous in lenticular pay zones (also commonly referred to in the art as compartmentalized reservoirs), for example, where there can be multiple, non-contiguous hydrocarbon-bearing subterranean zones. FIG. 1 shows a schematic of an illustrative lenticular pay zone 1 having isolated hydrocarbon-bearing subterranean zones 2 located therein. Hydrocarbon-bearing subterranean zones 2 can vary widely in size and shape. It can be difficult to penetrate a sufficient number of hydrocarbon-bearing subterranean zones in a lenticular pay zone while using only a single well, particularly a substantially vertical well. Even when multiple wells, optionally having lateral branches, are used to penetrate a greater number of hydrocarbon-bearing subterranean zones, the formation pressure may not be sufficiently high to enable free fluid flow from the well. In either case, production from the lenticular pay zone may not be economically feasible, even though significant amounts of hydrocarbon fluids may be present therein.

In cases where the formation pressure is insufficient to enable free fluid flow from a well, a lifting mechanism can be employed to assist in the production of a hydrocarbon fluid to the earth's surface. From an operational standpoint, it can often be desirable to have a substantially vertical production well when using a lifting mechanism to assist in fluid production. In a lenticular pay zone, this preference for a substantially vertical production well can make contact with multiple hydrocarbon-bearing subterranean zones problematic when using a single production well.

When multiple hydrocarbon-bearing subterranean zones are being simultaneously penetrated by several wells, the wells can be configured as drain wells to channel hydrocarbon fluid flow toward a few interlinked production wells. For example, the drain wells can be discharged into a collection well which directs the hydrocarbon fluid flow to the production wells. Use of one or more collection wells can be advantageous from the standpoint of pooling the hydrocarbon fluids into a larger volume that is more easily produced to the earth's surface. Pooling of hydrocarbon fluids into a larger volume can also make production more economically viable. In addition, directing the hydrocarbon fluid flow to a few production wells avoids having to control production and maintain a separate lifting mechanism at a large number of separate production wells.

SUMMARY OF THE INVENTION

The present disclosure generally relates to the production of fluids from a subterranean formation, and, more specifically, to subsurface well systems having multiple drain wells and methods for use thereof.

In some embodiments, a subsurface well system may be disclosed and may include a production well extending from the earth's surface, a collection region having a fluid connection to the production well and either being contiguous with the production well or comprising a collection well that intersects or is in fluid communication with the production well, and at least one branched drain well extending laterally from the production well and including one or more branches that extend from the at least one branched drain well, wherein at least one of the one or more branches intersects or is in fluid communication with the collection region.

In other embodiments, another subsurface well system may be disclosed and may include a production well extending from the earth's surface, a collection region having a fluid connection to the production well and either being contiguous with the production well or comprising a collection well that intersects or is in fluid communication with the production well, and a plurality of drain wells extending laterally from the production well and including one or more drain wells that intersect or are in fluid communication with the collection region, one or more drain wells that re-intersect or are in fluid communication with the production well at a point above the fluid connection, or any combination thereof.

In yet other embodiments, a method for drilling a subsurface well system may be disclosed. The method may include drilling a production well extending from the earth's surface, drilling a collection region having a fluid connection to the production well and either being contiguous with the production well or comprising a collection well that intersects or is in fluid communication with the production well, and drilling a plurality of drain wells extending laterally from the production well, the plurality of drain wells including one or more drain wells that intersect or are in fluid communication with the collection region, one or more drain wells that re-intersect or are in fluid communication with the production well at a point above the fluid connection, or any combination thereof, wherein one or more drain wells of the plurality of drain wells extend through at least one hydrocarbon-bearing subterranean zone.

The features and advantages of the present invention will be readily apparent to one having ordinary skill in the art upon a reading of the description of the preferred embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to one having ordinary skill in the art and having the benefit of this disclosure.

DETAILED DESCRIPTION

Figure 1:
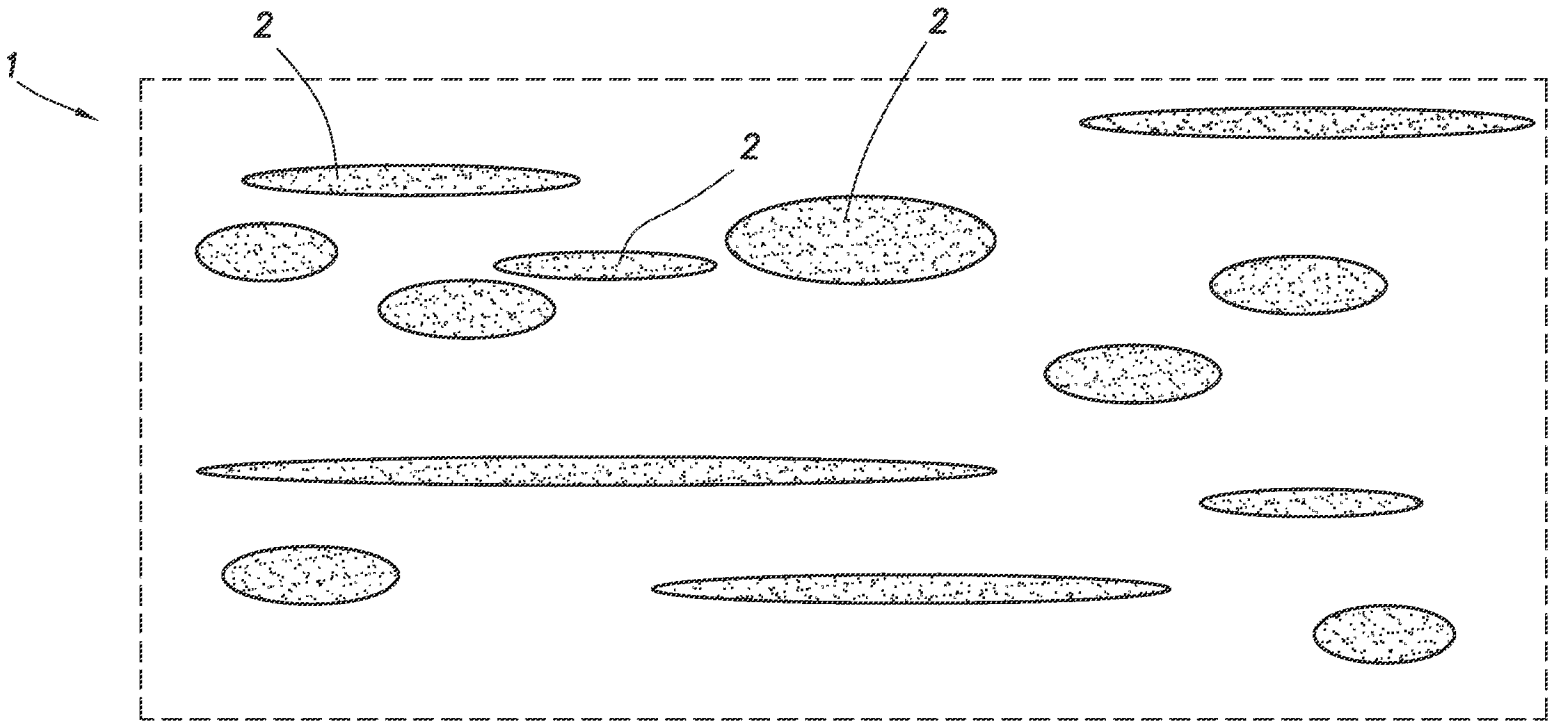
FIG. 1 shows a schematic of an illustrative lenticular pay zone having isolated hydrocarbon-bearing subterranean zones located therein.

The present disclosure generally relates to the production of fluids from a subterranean formation, and, more specifically, to subsurface well systems having multiple drain wells and methods for use thereof.

The embodiments described herein advantageously provide subsurface well systems having fewer surface penetrations than are routinely used in prior approaches to producing a lenticular pay zone or like subterranean formations having multiple hydrocarbon-bearing subterranean zones therein. In particular, some embodiments described herein utilize one or more drain wells extending laterally from a single production well, where the drain wells do not penetrate the earth's surface. That is, some embodiments described herein present subsurface well systems that extend from the earth's surface in only one location (e.g., at the production well). For example, in some embodiments described herein, multiple drain wells can be drilled from the production well, where the drain wells do not penetrate the earth's surface. As used herein, the term "earth's surface" will refer to the earth's crust and any covering thereon (e.g., water, ice and the like).

The embodiments described herein may be advantageous for producing subterranean formations located in environmentally sensitive locales or in which surface drilling conditions are difficult (e.g., offshore drilling), where it can be environmentally undesirable, costly, or otherwise impractical to drill multiple surface wells. By having multiple drain wells extending laterally from a single production well, a smaller total well length can also be realized than if the drain wells extend from the earth's surface. The embodiments described herein can be particularly advantageous when utilized in lenticular pay zones, where the subterranean formation as a whole contains sufficient hydrocarbons to be economically viable, but there are insufficient hydrocarbon reserves in each hydrocarbon-bearing subterranean zone to justify drilling multiple surface wells to separately produce each zone.

In the present embodiments, a plurality of hydrocarbon-bearing subterranean zones (e.g., in a lenticular pay zone) can be efficiently produced by pooling the hydrocarbons contained therein into one or more collection regions that deliver the pooled hydrocarbons to a production well. As used herein, the term "collection region" refers to a wellbore segment that is either contiguous with the production well or comprises a separately drilled collection well. A collection region that is contiguous with a production well may comprise, for example, the substantially non-vertical heel to toe portion of a wellbore that is drilled from a production well extending from the earth's surface. Several embodiments herein will be described using the term "collection well" to denote a separately drilled collection region. However, it is to be recognized that any described embodiment having a separately drilled collection well can be practiced similarly using a wellbore having a collection region that is contiguous with the production well.

Multiple drain wells emanating from the production well can be used to deliver the hydrocarbons to the collection region. In some embodiments, the drain wells can intersect or otherwise be in fluid communication with the collection region. In some or other embodiments, the drain wells can re-intersect or otherwise be in fluid communication with the production well. As used herein, the term "fluid communication" refers to a condition in which a fluid can flow from a first well to a second well without there being an apparent mechanical connection between the two wells. For example, a drain well can be in fluid communication with a collection region or a production well if a fluid in the drain well can percolate to the collection region or production well via natural or artificially introduced porosity within the subterranean formation (e.g., fractures). In some embodiments, fluid communication can be established between two wells by drilling the wells suitably close to one another and then perforating the space between them with a perforation gun. Unless otherwise specified herein, use of the terms "intersect," "intersection," and grammatical equivalents thereof will be understood to represent both a physical connection and/or a fluid communication between two wells. The pooling of a hydrocarbon fluid from multiple drain wells into a single production well can enable a single fluid lift mechanism to be utilized in the production well, which can be more efficient and less costly than operating a fluid lift mechanism in multiple wells.

A particular advantage of re-intersecting a drain well with the production well after draining a hydrocarbon-bearing subterranean zone is that the hydrocarbon fluid can be transported directly to the production well without having to be returned via the collection region. Another advantage of re-intersecting a drain well with the production well is that, in some instances, an overall shorter well length can be realized than if the drain well is extended all the way to the collection region.

In some embodiments, subsurface well systems described herein can comprise a production well extending from the earth's surface; a collection region having a fluid connection to the production well, wherein the collection region is contiguous with the production well or comprises a collection well that intersects or is in fluid communication with the production well; and at least one branched drain well that extends laterally from the production well, wherein the at least one branched drain well comprises at least one branch, and one or more of the branches intersect or are in fluid communication with the collection region. In some embodiments, the subsurface well systems may extend from the earth's surface in only one location.

In some embodiments, subsurface well systems described herein can comprise a production well extending from the earth's surface; a collection region having a fluid connection to the production well, wherein the collection region is contiguous with the production well or comprises a collection well that intersects or is in fluid communication with the production well; and a plurality of drain wells that extend laterally from the production well, wherein one or more of the drain wells intersect or are in fluid communication with the collection region, one or more of the drain wells re-intersect or are in fluid communication with the production well at a point above the fluid connection of the collection region to the production well, or any combination thereof. In some embodiments, the subsurface well systems may extend from the earth's surface in only one location.

In the embodiments described herein, the collection region (e.g., a collection well) can be at any angle relative to the earth's surface. However, to promote fluid collection, it is typically desirable that the collection region is downwardly sloped toward the production well. As used herein, the term "downwardly sloped" refers to at least some deviation away from horizontal relative to the earth's surface. As the term "downwardly sloped" refers to a collection well, a downwardly sloped collection well has a first end intersecting the production well that is farther below the earth's surface than is a second end of the collection well that is nearer the earth's surface. As the term "downwardly sloped" refers to a collection region that is contiguous with the production well, a downwardly sloped collection region has the wellbore heel farther below the earth's surface than the wellbore toe, which is nearer the earth's surface. It is to be recognized that a downwardly sloped collection region will benefit from gravity in the transport of a hydrocarbon fluid to the production well. However, it is also to be recognized that if the collection region possesses an excessive degree of downward slope, a production well that is deeper than necessary can be required to intersect the collection region. Thus, a downward slope of the collection region can be chosen that adequately takes advantage of gravity-assisted fluid transfer, while not necessitating that the production well be excessively deep. In some embodiments, the collection region can be sloped downward at an angle of about 60 degrees or less relative to the earth's surface. In some embodiments, the collection region can be sloped downward at an angle of about 45 degrees or less relative to the earth's surface. In some embodiments, the collection region can be sloped downward at an angle of about 30 degrees or less relative to the earth's surface. In some embodiments, the collection region can be sloped downward at an angle of about 25 degrees or less relative to the earth's surface. In some embodiments, the collection region can be sloped downward at an angle of about 20 degrees or less relative to the earth's surface. In some embodiments, the collection region can be sloped downward at an angle of about 15 degrees or less relative to the earth's surface. In some embodiments, the collection region can be sloped downward at an angle of about 10 degrees or less relative to the earth's surface. In some embodiments, the collection region can be sloped downward at an angle of about 5 degrees or less relative to the earth's surface. It is also to be recognized that the collection region can lack a downward slope in alternative embodiments, but the fluid transport will not benefit from gravity in this case.

It is also to be noted that fluid flow in the subsurface well systems need not rely exclusively on gravity. In some embodiments, any portion of the subsurface well systems can be configured such that it can be pressurized (e.g., with steam, water, or a like fluid). Pressurization of the well systems can promote fluid movement therein and aid in the draining of a hydrocarbon-bearing subterranean zone. Appropriate techniques for pressurizing a subsurface well system are described in commonly owned U.S. Pat. No. 7,451,814, which is incorporated herein by reference in its entirety.

Figure 2:
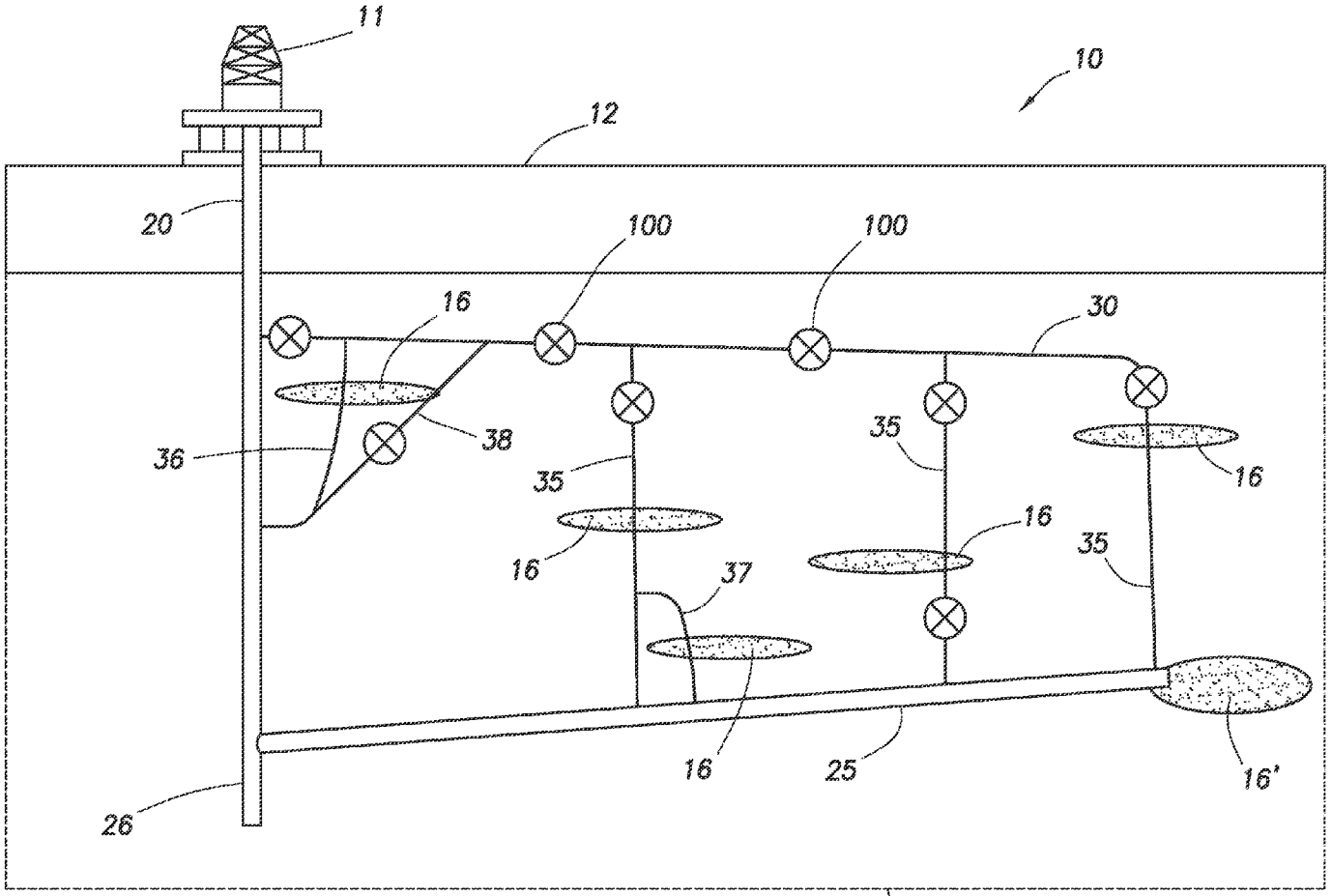
FIG. 2 shows an illustrative schematic of a subsurface well system having a branched drain well extending laterally from the production well.

FIG. 2 shows an illustrative schematic of a subsurface well system 10 having a branched drain well 30 extending laterally from the production well 20. As shown in FIG. 2, subsurface well system 10 is located within lenticular pay zone 15 having one or more hydrocarbon-bearing subterranean zones 16 located therein. Wellhead 11 is located on earth's surface 12, where earth's surface 12 can be the earth's crust, water, ice and the like. Subsurface well system 10 contains collection well 25 that intersects production well 20. Although FIG. 2 has depicted only a single collection well, it is to be recognized that any number of collection wells can be present, if desired. Further, in some embodiments, collection well 25 can comprise a collection region that is contiguous with production well 20, as noted previously. Collection well 25 can intersect production well 20 at any desired location along the axial length of production well 20. In some embodiments, collection well 25 can intersect production well 20 at its lowermost point. In some embodiments, collection well 25 can intersect production well 20 above its lowermost point, thereby creating sump 26 in which hydrocarbons can pool and subsequently be produced to the earth's surface. When multiple collection wells are present, they need not intersect production well 20 at substantially the same point. In embodiments in which a contiguous collection region is present in lieu of collection well 25, sump 26 may comprise an enlarged region at the heel of the wellbore, where excess hydrocarbon fluids may collect.

In some embodiments, at least one branched drain well 30 can extend laterally from production well 20. Although FIG. 2 has shown only one branched drain well 30 extending from production well 20, it is to be recognized that any number of branched drain wells can be present. Furthermore, any number of branches can be present in or otherwise extend from branched drain well 30. In some embodiments, at least some of the branches can intersect collection well 25, or a collection region, if present. As depicted in FIG. 2, branches 35 can intersect with collection well 25. In some embodiments, at least some of the branches can intersect production well 20. As depicted in FIG. 2, branch 36 can intersect production well 20 above a point where collection well 25 intersects or is in fluid communication with production well 20. That is, branch 36 can intersect production well 20 at a point above the fluid connection of the collection region to the production well. Any number of branches 35 can intersect collection well 25, and any number of branches 36 can intersect production well 20. Furthermore, in some embodiments, the branches can themselves be further branched (e.g., branch 37) or intersect with other branches (e.g., branch 38). Although FIG. 2 has depicted only 5 branches extending directly from branched drain well 30, it is to be recognized that any number of branches can be present depending, at least in part, on the number of hydrocarbon-bearing subterranean zones 16 that need to be drained.

In some embodiments, the collection region can be located below the hydrocarbon-bearing subterranean zones through which the drain wells extend. Such an embodiment is depicted in FIG. 2. In alternative embodiments, the collection region can be located above at least some of the hydrocarbon-bearing subterranean zones, if desired.

In some of the embodiments described herein, the collection region can intersect at least one hydrocarbon-bearing subterranean zone. Although FIG. 2 has depicted collection well 25 intersecting hydrocarbon-bearing subterranean zone 16', it is to be recognized that the intersecting feature is optional. Whether the collection region intersects a hydrocarbon-bearing subterranean zone will depend upon operational considerations that will be evident to one having ordinary skill in the art.

Figure 3:
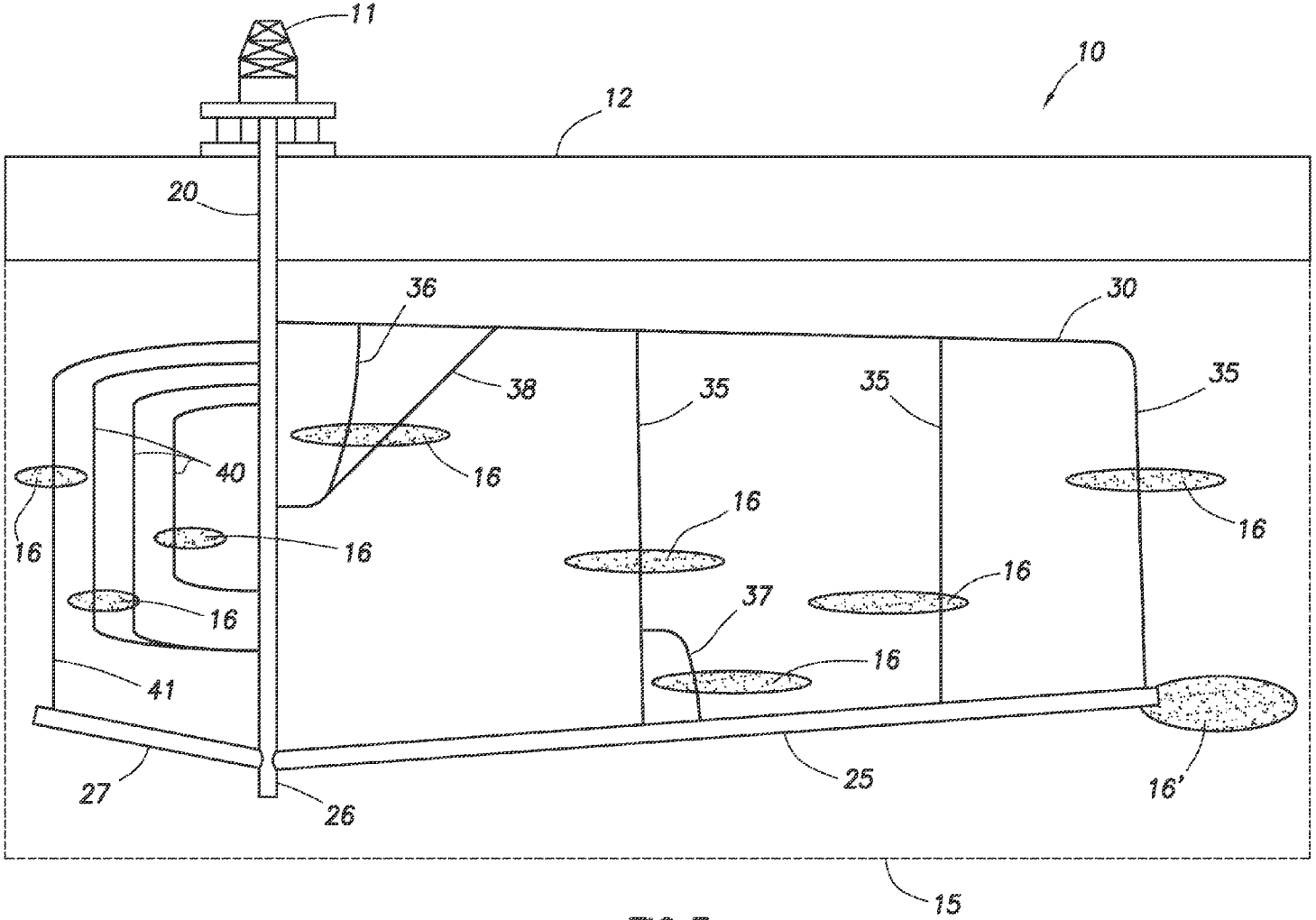
FIG. 3 shows an illustrative schematic of a subsurface well system having a branched drain well, a drain well intersecting the production well, and a drain well intersecting the collection well, all extending laterally from the production well.

In some embodiments, the subsurface well systems described herein can further comprise at least one drain well that extends laterally from the production well and re-intersects or is in fluid communication with the production well at a point above the fluid connection of the collection region to the production well. FIG. 3 shows an illustrative schematic of a subsurface well system 10 having a branched drain well 30, drain wells 40 intersecting production well 20, and a drain well 41 intersecting collection well 27, all extending laterally from production well 20. Again, it is to be recognized that the collection wells depicted in FIG. 3 can be replaced by collection regions that are contiguous with production well 20, if desired. As depicted in FIG. 3, drain wells 40 can extend laterally from production well 20 and reconnect thereto after passing through hydrocarbon-bearing subterranean zones 16, but above a point where collection wells 25 and 27 establish a fluid connection to production well 20. In some embodiments, drain wells 40 can optionally contain branches and/or intersect other drain wells. Although FIG. 3 has depicted three drain wells 40 re-intersecting production well 20, it is to be recognized that any number of drain wells 40 can be present depending upon operational considerations. The remaining features in FIG. 3 are the same as described above in FIG. 2 and therefore will not be described again in detail.

In some or other embodiments, drain wells can be present in addition to or in lieu of drain wells 40 that re-intersect or are in fluid communication with production well 20. Specifically, in some embodiments, at least one drain well can extend laterally from the production well and intersect or be in fluid communication with the collection region. Referring again to FIG. 3, drain well 41 can extend laterally from production well 20 and intersect collection well 27. Again, although FIG. 3 has depicted a single drain well 41 extending laterally from production well 20 and intersecting collection well 27, it is to be recognized that any number of such drain wells can be present in the embodiments described herein. Furthermore, whether a drain well is configured to re-intersect the production well or extend to the collection well will be dependent on operational considerations. For example, in some embodiments, a shorter total well length may be realized by reconnecting a drain well to the production well as opposed to extending the drain well to the collection well.

In some embodiments, the subsurface well systems can further comprise a plurality of drain wells that extend laterally from the production well, where one or more of the drain wells within the plurality intersect or are in fluid communication with the collection region, one or more of the drain wells within the plurality re-intersect or are in fluid communication with the production well at a point above the fluid connection of the collection region to the production well, or any combination thereof. Optionally, any of the drain wells within the plurality can be branched and/or intersect or be in fluid communication other drain wells.

As depicted in FIGS. 2 and 3, the drain wells and branches emanating therefrom have, in most cases, been drawn as having approximately a 90° union at their termini. However, it is to be recognized that this angle of intersection has been presented for purposes of drawing simplicity only, and any angle of intersection can be used in any of the embodiments described herein while remaining within the spirit and scope of the present disclosure. In various embodiments, the angle of intersection of the terminus nearer the earth's surface and the angle of intersection of the terminus remote from the earth's surface need not necessarily be the same. Furthermore, all drain wells and branches need not necessarily have the same angle of intersection at their termini.

Furthermore, although the drain wells and the branches emanating therefrom have, in most cases, been drawn as being substantially parallel with the production well, this feature is not required. In general, any orientation of the drain wells and branches emanating therefrom is contemplated within the spirit and scope of the present disclosure. In some embodiments, the drain wells can be configured in a spiral configuration about the production well before re-intersecting the production well or intersecting the collection region.

It is also to be noted in FIGS. 2 and 3 that each drain well or branch emanating therefrom can pass through any number of hydrocarbon-bearing subterranean zones. Although FIGS. 2 and 3 have depicted each drain well or branch as passing through only one hydrocarbon-bearing subterranean zone, it is to be recognized that a drain well or branch can pass through multiple hydrocarbon-bearing subterranean zones, if desired, depending upon operational considerations. Furthermore, a hydrocarbon-bearing subterranean zone can be penetrated by multiple drain wells or branches, if desired (see FIG. 3).

Figure 4:
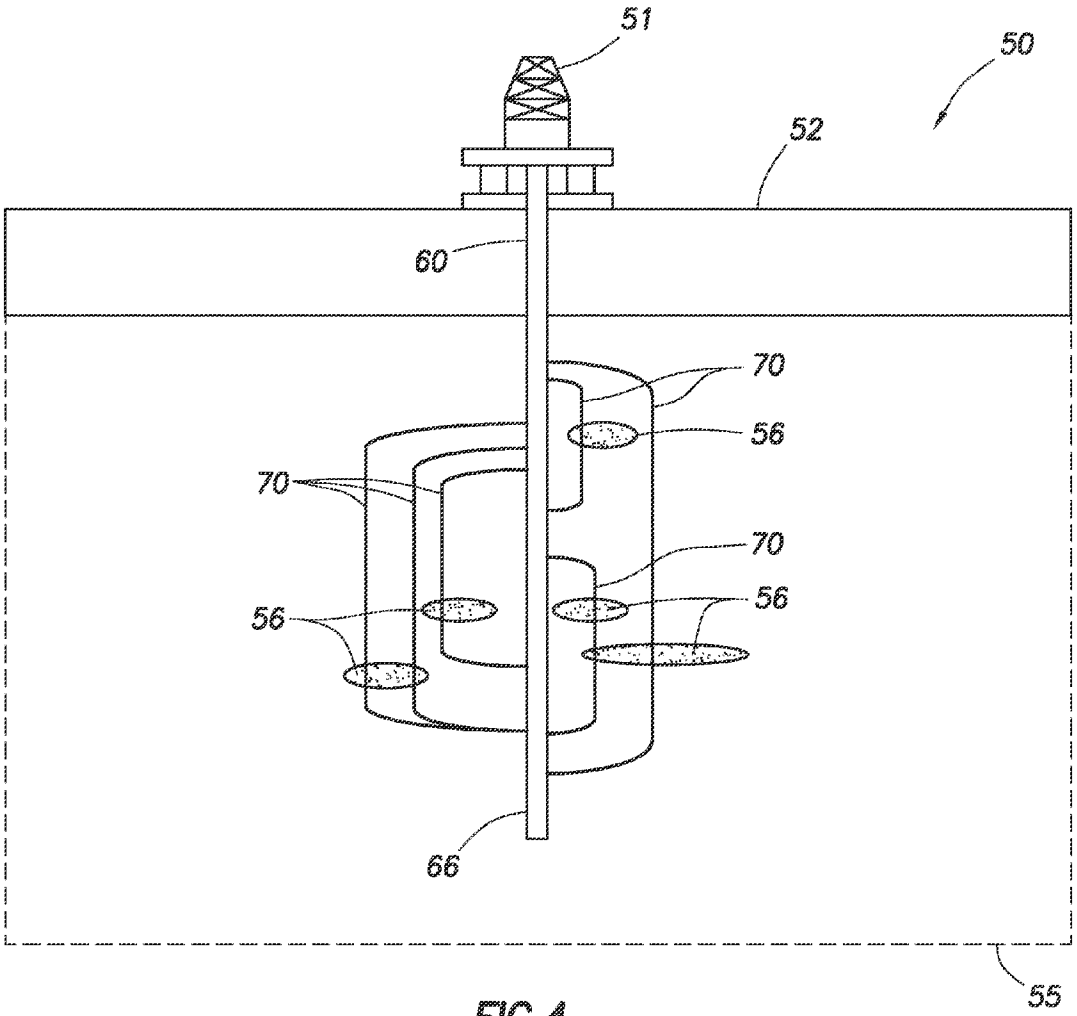
FIG. 4 shows an illustrative schematic of a subsurface well system having a plurality of drain wells extending laterally from the production well and re-intersecting thereto.

In some embodiments, all of the drain wells can directly extend laterally from the production well, rather than some of the drain wells being present as a branch extending from a lateral well (i.e., a branched drain well), as depicted in FIGS. 2 and 3. FIG. 4 shows an illustrative schematic of a subsurface well system 50 having a plurality of drain wells 70 extending laterally from production well 60 and re-intersecting thereto. When all of the drain wells re-intersect the production well, separate collection wells may optionally be omitted from the subsurface well systems. In such embodiments, the collection region may simply comprise a sump 66 or like structure at the bottom of production well 60, where drain wells 70 re-intersect production well 60 above its lowest point. As depicted in FIG. 4, subsurface well system 50 is located within lenticular pay zone 55, having hydrocarbon-bearing subterranean zones 56 located therein. Wellhead 51 is located on earth's surface 52, where earth's surface 52 can be the earth's crust, water, ice, and the like. Subsurface well system 50 contains production well 60 which connects to sump 66 in which hydrocarbon fluids may be collected. Drain wells 70 can penetrate one or more hydrocarbon-bearing subterranean zones 56 and subsequently re-intersect or be in fluid communication with production well 60. Drain wells 70 can optionally be branched and/or intersect or be in fluid communication with other drain wells before re-intersecting or being in fluid communication with production well 60.

Figure 5:
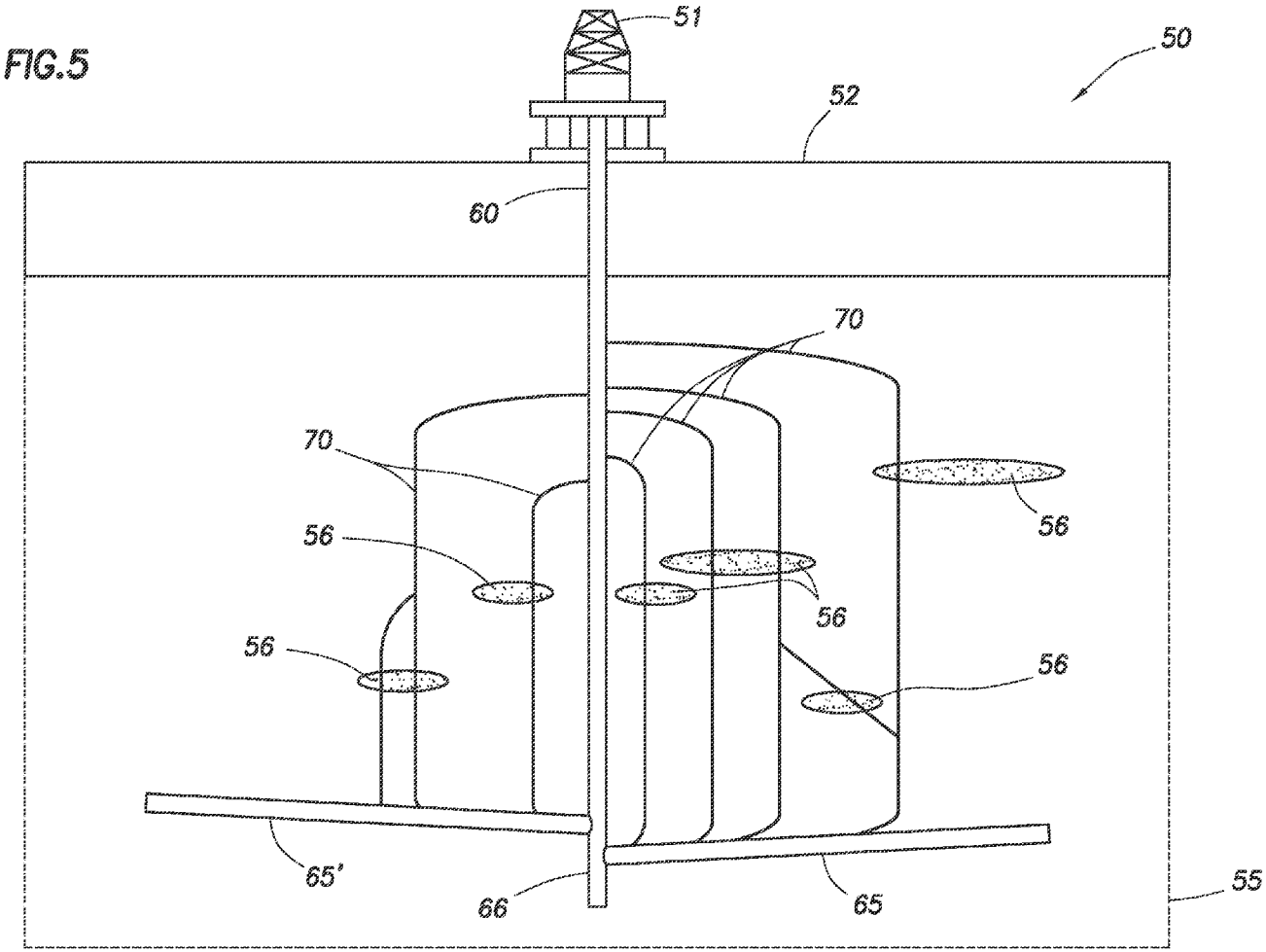
FIG. 5 shows an illustrative schematic of a subsurface well system having a plurality of drain wells extending laterally from the production well and intersecting the collection well.

FIG. 5 shows an illustrative schematic of a subsurface well system 50 having a plurality of drain wells 70 extending laterally from production well 60 and intersecting collection wells 65 and 65'. In the embodiment depicted in FIG. 5, all of the drain wells 70 intersect or are in fluid communication with collection wells 65 and 65', as opposed to re-intersecting or being in fluid communication with production well 60, as in FIG. 4. Thus, collection wells 65 and 65' are not omitted in FIG. 5. Again, drain wells 70 can optionally be branched and/or intersect other drain wells prior to intersecting or being in fluid communication with collection wells 65 and 65'. Other reference characters in FIG. 5 have their same meaning and description as in FIG. 4 and therefore will not be described again in detail.

Figure 6:
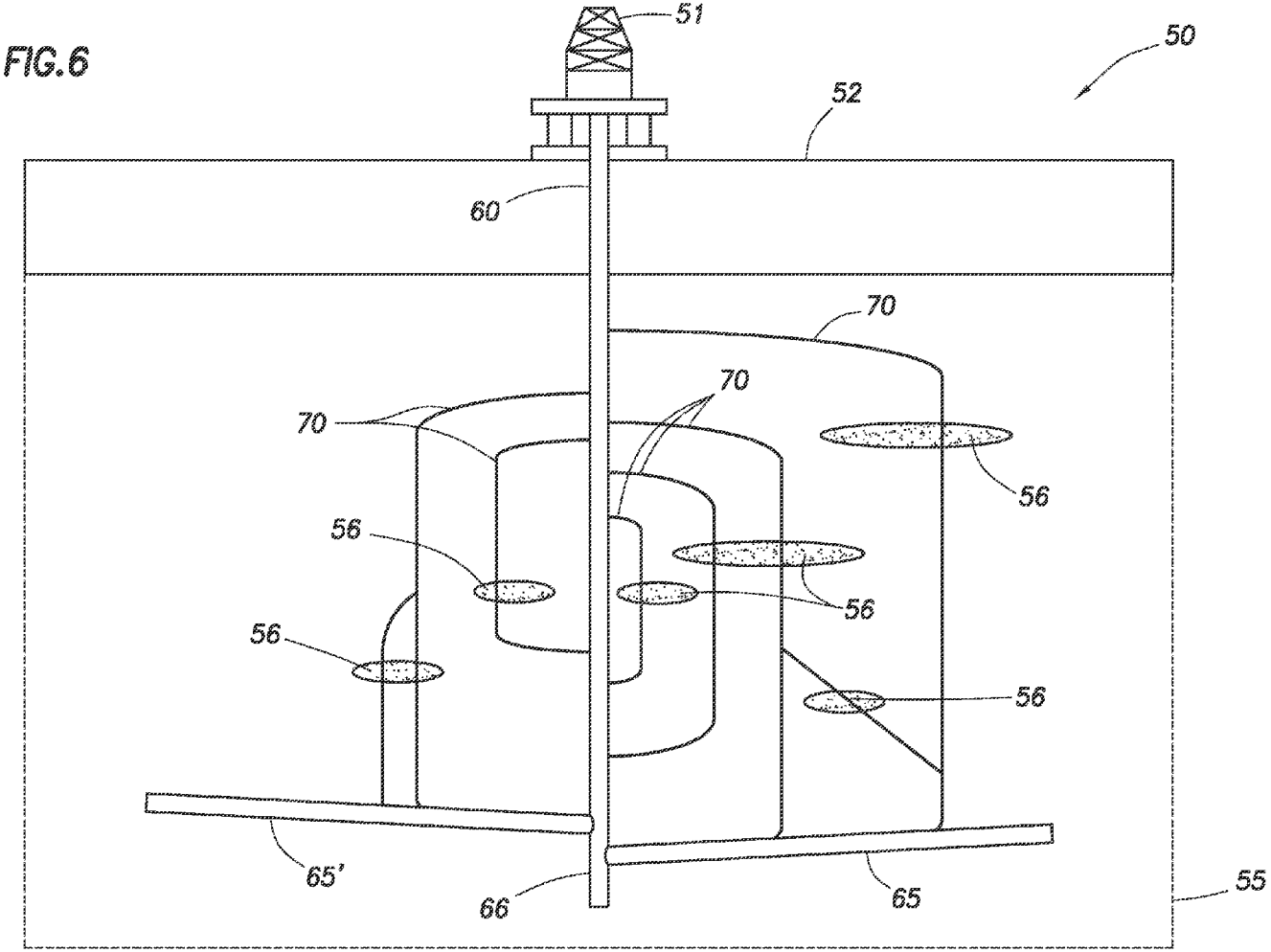
FIG. 6 shows an illustrative schematic of a subsurface well system having a plurality of drain wells extending laterally from the production well, where some of the drain wells re-intersect the production well and some of the drain wells intersect the collection wells.

In some embodiments, a plurality of drain wells can extend laterally from the production well, where one or more of the drain wells intersect or are in fluid communication with the collection region and one or more of the drain wells re-intersect or are in fluid communication with the production well. FIG. 6 shows an illustrative schematic of subsurface well system 50 having a plurality of drain wells 70 extending laterally from production well 60, where some of drain wells 70 re-intersect production well 60 and some of drain wells 70 intersect collection wells 65 and 65'. In essence, the subsurface well system depicted in FIG. 6 comprises a hybrid of the features depicted in the subsurface well systems of FIGS. 4 and 5. Reference characters in FIG. 6 have their same meaning and description as in FIGS. 4 and 5 and therefore will not be described again in detail.

In further reference to FIGS. 5 and 6, it is to be recognized that the depiction of two collection wells (65 and 65') is for purposes of illustration and not limitation. Any number of collection wells can be present according to the embodiments described herein. As described above, the collection wells can have a downward slope toward the production well in some embodiments. Furthermore, in some embodiments, instead of a collection well, a collection region that is contiguous with the production well can be used in an essentially equivalent manner.

It is to be noted that the subsurface well systems described hereinabove can further comprise one or more valves or other like means to control fluid flow or otherwise isolate certain portions of the system. Illustrative positions for valves 100 or like pressure isolation mechanisms have been indicated in FIG. 2. One of ordinary skill in the art will recognize appropriate locations at which valves can be utilized in the present subsurface well systems, and the positions depicted in FIG. 2 should not be considered as limiting. For purposes of clarity, these valves have been omitted from FIGS. 3-6. Furthermore, one of ordinary skill in the art will recognize appropriate actuation mechanisms for opening and closing such valves. In some embodiments, at least some of the drain wells can have a valve associated therewith that can shut off the flow of fluid through the drain well or branches extending therefrom. For example, during the course of producing a hydrocarbon fluid from a subterranean formation, a hydrocarbon-bearing subterranean zone may begin to produce too much water relative to the amount of produced hydrocarbons. By shutting off the drain well(s) penetrating the offending subterranean zone, hydrocarbon production can continue from the rest of the hydrocarbon-bearing subterranean zones. In other cases, certain drain wells can be shut off such that only certain portions of the subsurface well system are treated in a stimulation or remediation operation, as necessary. In another embodiment, valves can be used to increase suction in selected drain wells by shutting off production from other wells. In some embodiments, sensors can be deployed within the subsurface well system to indicate which valves need to be opened or closed to optimize production. For example, the type and rate of fluid flow as well as its temperature can be monitored with the sensors. Use of such sensors will be familiar to one having ordinary skill in the art.

In any of the embodiments described herein, the drain wells and/or branches extending therefrom can be cased or uncased. In some embodiments, the drain wells can be produced open hole. In other embodiments, the drain wells can be completed and then perforated before being produced. Likewise, in various embodiments, the production well and the collection region can be cased or uncased, as desired.

Figure 7:
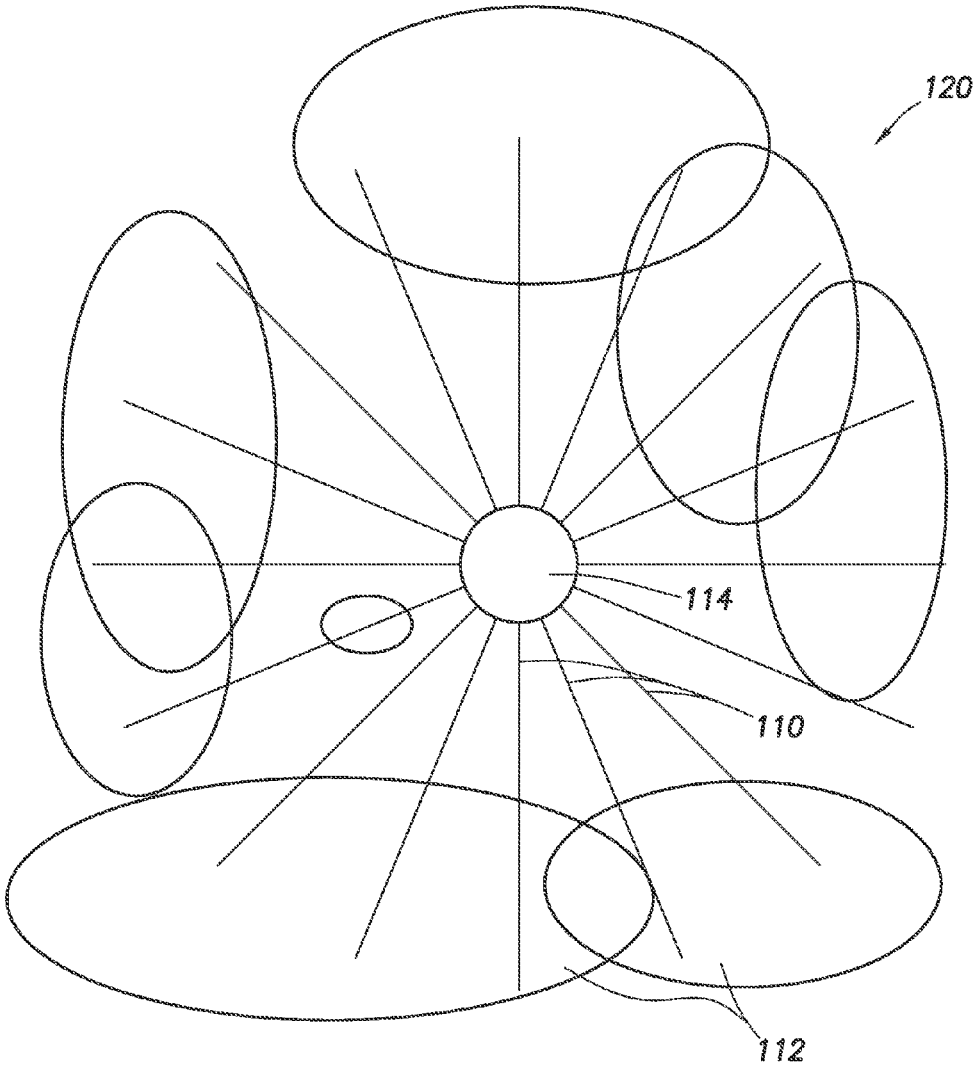
FIG. 7 shows an illustrative top view schematic of a subsurface well system located in a lenticular pay zone in which a plurality of collection wells are used to channel a hydrocarbon fluid from hydrocarbon-bearing subterranean zones toward a production well.

It is to be further noted that although FIGS. 2-6 have depicted the lenticular pay zone in a two-dimensional manner, it is to be recognized that the hydrocarbon-bearing subterranean zones can be distributed radially about the production well. Accordingly, the subsurface well systems can also extend radially about the production well such that as many hydrocarbon-bearing subterranean zones as possible are penetrated and drained. FIG. 7 shows an illustrative top view schematic of a subsurface well system 120 located in a lenticular pay zone in which a plurality of collection regions 110 are used to channel a hydrocarbon fluid from hydrocarbon-bearing subterranean zones 112 toward production well 114. Drain wells intersecting or in fluid communication with collection region 110 and/or production well 114 extend into the plane of the page and are not shown. Any number of collection regions, drain wells, and intersections or fluid communication points therebetween can be used in draining a radially spaced lenticular pay zone.

In any of the subsurface well systems described herein, the subsurface well systems can further comprise a fluid lift mechanism. The fluid lift mechanism can assist in the transport of a hydrocarbon fluid to the earth's surface, particularly in a pay zone in which the formation pressure alone is insufficient to produce a fluid from the subterranean formation. Suitable fluid lift mechanisms can include, without limitation, beam lift systems, electrically powered submersible pumps, a reciprocating rod pump driven by a pump jack, a progressive cavity pump powered by a rotating rod string, a hydraulically powered jet pump, a gas lift system, and the like. In at least one embodiment, the fluid lift mechanism can be arranged within the sump portion of the production well.

Although the above description has primarily focused on use of the present subsurface well systems in a low pressure subterranean formation, particularly those in which use of a fluid lift mechanism may be desirable, it is to be recognized that the subsurface well systems may be used in any type of subterranean formation. In some embodiments, the subsurface well systems described herein may be used in a subterranean formation that has sufficient pressure therein to produce a hydrocarbon fluid from the formation. Use of the subsurface well systems in such subterranean formations may allow a hydrocarbon reservoir therein to be drained from multiple exit points and conveniently produced from a single production well. Furthermore, through placement of valves in the subsurface well systems, downhole pressure distribution and backflow may be controlled, for example. Distribution and leveling of the downhole pressure may lead to improved hydrocarbon recovery rates during production. In addition, the ability to distribute downhole pressure may allow higher pressure regions of the subterranean formation to pressurize lower pressure regions. Use of the present subsurface well systems in this manner may allow less dependence on injection operations to be realized. Use and placement of valves suitable for achieving downhole pressure regulation in the foregoing manner will be familiar to one having ordinary skill in the art.

Also contemplated herein are various methods for drilling and using the present subsurface well systems in hydrocarbon fluid production. In some embodiments, methods described herein can comprise providing a subsurface well system comprising a production well extending from the earth's surface; a collection region having a fluid connection with the production well, wherein the collection region is contiguous with the production well or comprises a collection well that intersects or is in fluid communication with the production well; and a plurality of drain wells that extend laterally from the production well, wherein one or more of the drain wells intersect or are in fluid communication with the collection region, one or more of the drain wells re-intersect or are in fluid communication with the production well at a point above the fluid connection of the collection region to the production well, or any combination thereof, and wherein one or more of the drain wells extend through at least one hydrocarbon-bearing subterranean zone; and producing a hydrocarbon fluid from the subsurface well system. Suitable subsurface well systems can include, but are not limited to, those depicted in FIGS. 2-6, which are described in more detail hereinabove.

In some embodiments, the methods for drilling a subsurface well system can comprise drilling a production well extending from the earth's surface; drilling a collection region having a fluid connection to the production well, wherein the collection region is contiguous with the production well or comprises a collection well that intersects or is in fluid communication with the production well; and drilling a plurality of drain wells that extend laterally from the production well, wherein one or more of the drain wells intersect or are in fluid communication with the collection region, one or more of the drain wells re-intersect or are in fluid communication with the production well at a point above the fluid connection of the collection region to the production well, or any combination thereof, and wherein one or more of the drain wells extend through at least one hydrocarbon-bearing subterranean zone.

In some embodiments, the methods can further comprise producing a hydrocarbon fluid from the subsurface well system. In some embodiments, the present methods can further comprise performing a treatment operation in at least some of the hydrocarbon-bearing subterranean zones through which the drain wells extend. Treatment operations can include, for example, stimulation operations and remediation operations. Illustrative stimulation and remediation operations can include, for example, fracturing operations, gravel packing operations, fluid injection operations, conformance treatments, fluid loss control operations, acidizing treatments, sand control operations, damage control operations (e.g., paraffin removal operations), and the like.

In producing a hydrocarbon fluid from a lenticular pay zone, any of the drain wells can be operated as an injection well to inject a fluid that drives the hydrocarbon fluid toward the production well. That is, in some embodiments, the methods may include pressurization of the subsurface well system with a fluid. Illustrative injected fluids can include, for example, steam, water, nitrogen, carbon dioxide, and the like.

When drilling the present subsurface well systems, various lateral drilling techniques and tools can be utilized. Such lateral drilling techniques and tools will be familiar to one having ordinary skill in the art. Illustrative lateral drilling techniques and tools are described in U.S. Pat. Nos. 4,658,916, 5,458,209, and 6,920,945, each of which is incorporated herein by reference in its entirety. In some embodiments, a whipstock may be used to conduct the lateral drilling. Use of other lateral drilling tools and techniques are possible, and the foregoing examples are meant to be illustrative and non-limiting.

In general, when drilling the present subsurface well systems, the production well can first be drilled from the earth's surface. Thereafter, the drain wells can be extended from the production well by various lateral drilling techniques. The collection region can be drilled either before or after drilling the drain wells, depending on operational requirements. For example, a collection region that is contiguous with the production well may be drilled in the same drilling operation that defines the production well. In some embodiments, each drain well can physically intersect the production well or the collection region. In other embodiments, the drain wells can simply be in fluid communication with the production well or the collection region. Fluid communication can result from native permeability of the formation, or fluid communication can be established by perforating the space between the drain well and the production well or collection region. Illustrative techniques for lateral drilling, intersecting wellbores, and establishing fluid communication between wellbores are described in commonly owned U.S. Pat. No. 7,819,187, which is incorporated herein by reference in its entirety. In drilling the drain wells to the production well or the collection region, various remote sensing techniques can be used to guide the drilling such that each drain well intersects or establishes fluid communication with the production well or collection region. Optional completion or treatment operations can be conducted during or following drilling.

In alternative embodiments of the present methods, a fluid other than a hydrocarbon fluid can be produced using the subsurface well systems. For example, in some embodiments, a hydrocarbon gas (e.g., methane) can be produced using the subsurface well systems. In still other embodiments, formation water can be removed from a subterranean formation before producing a hydrocarbon fluid or hydrocarbon gas therefrom. For example, the present subsurface well systems can be utilized in coal bed methane production, which can require extensive dewatering to take place before natural gas flow begins.

Therefore, the present invention is well adapted to attain the ends and advantages mentioned as well as those that are inherent therein. The particular embodiments disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present invention. The invention illustratively disclosed herein suitably may be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A subsurface well system, comprising:

a production well extending from the earth's surface;

a collection region having a fluid connection to the production well and comprising a collection well that intersects or is in fluid communication with the production well; and at least one branched drain well extending laterally from the production well and including one or more branches that extend from the at least one branched drain well, wherein at least one of the one or more branches intersects or is in fluid communication with the collection region.

2. The subsurface well system of claim 1, wherein at least one of the one or more branches re-intersects or is in fluid communication with the production well at a point above the fluid connection.

3. The subsurface well system of claim 1, wherein at least one of the one or more branches intersects or is in fluid communication with another one of the one or more branches.

4. The subsurface well system of claim 1, wherein the subsurface well system extends from the earth's surface in only one location.

5. The subsurface well system of claim 1, wherein the collection region is downwardly sloped toward the production well.

6. The subsurface well system of claim 1, further comprising:

at least one drain well extending laterally from the production well and either re-intersecting or in fluid communication with the production well at a point above the fluid connection, at least one drain well that extends laterally from the production well and intersects or is in fluid communication with the collection region, or any combination thereof.

7. The subsurface well system of claim 1, further comprising:

a plurality of drain wells extending laterally from the production well, wherein one or more drain wells of the plurality of drain wells re-intersect or are in fluid communication with the production well at a point above the fluid connection, one or more drain wells of the plurality of drain wells intersect or are in fluid communication with the collection region, or any combination thereof.

8. The subsurface well system of claim 7, wherein one or more drain wells of the plurality of drain wells are branched.

9. The subsurface well system of claim 7, wherein one or more drain wells of the plurality of drain wells intersect or are in fluid communication with other drain wells of the plurality of drain wells.

10. A subsurface well system, comprising:

a production well extending from the earth's surface;

a collection region having a fluid connection to the production well and comprising a collection well that intersects or is in fluid communication with the production well; and a plurality of drain wells extending laterally from the production well and including one or more drain wells that re-intersect or are in fluid communication with the production well at a point above the fluid connection.

11. The subsurface well system of claim 10, wherein the subsurface well system extends from the earth's surface in only one location.

12. The subsurface well system of claim 10, wherein one or more drain wells of the plurality of drain wells intersect or are in fluid communication with other drain wells of the plurality of drain wells.

13. The subsurface well system of claim 10, wherein one or more drain wells of the plurality of drain wells are branched.

14. A method for drilling a subsurface well system, the method comprising:

drilling a production well extending from the earth's surface;

drilling a collection region having a fluid connection to the production well and comprising a collection well that intersects or is in fluid communication with the production well; and drilling a plurality of drain wells extending laterally from the production well, the plurality of drain wells including one or more drain wells that re-intersect or are in fluid communication with the production well at a point above the fluid connection, wherein one or more drain wells of the plurality of drain wells extend through at least one hydrocarbon-bearing subterranean zone.

15. The method of claim 14, wherein one or more drain wells of the plurality of drain wells are branched.

16. The method of claim 14, wherein one or more drain wells of the plurality of drain wells intersect or are in fluid communication with other drain wells of the plurality of drain wells.

17. The method of claim 14, wherein the collection region intersects the at least one hydrocarbon-bearing subterranean zone.

18. The method of claim 14, wherein the collection region is located below the at least one hydrocarbon-bearing subterranean zone through which the one or more drain wells of the plurality of drain wells extend.

19. The subsurface well system of claim 10, wherein the plurality of drain wells further include one or more drain wells that intersect or are in fluid communication with the collection region.

20. The method of claim 14, wherein drilling the plurality of drain wells includes drilling one or more drain wells that intersect or are in fluid communication with the collection region.

* * * * *